US006012203A

United States Patent [19]

Baron Pearson

[11] Patent Number: 6,012,203

[45] Date of Patent: Jan. 11, 2000

[54] INTERCHANGE SNAP-ON ADORNMENTS FOR FASHION ACCESSORIES

[76] Inventor: Pamela B. Baron Pearson, 6011 Citrine Ct., Boynton Beach, Fla. 33437

[21] Appl. No.: 09/265,724

[22] Filed: Mar. 9, 1999

[51] Int. Cl.[7] ..... A43C 5/00; A44B 17/00

[52] U.S. Cl. ..... 24/114.9; 24/90.1; 24/108

[58] Field of Search ..... 24/114.9, 90.1, 24/108

[56] References Cited

U.S. PATENT DOCUMENTS

| | | | |
|---|---|---|---|
| 488,219 | 12/1892 | Platt | 24/108 |
| 833,628 | 10/1906 | Plowman | 24/90.1 |
| 1,336,243 | 4/1920 | Lee | 24/108 |
| 2,128,095 | 8/1938 | Levy | 24/114.9 |
| 2,596,965 | 5/1952 | Troy | 24/114.9 |
| 2,748,517 | 6/1956 | Berkis | 24/114.9 |
| 3,439,439 | 4/1969 | Stimson | 24/114.9 |

FOREIGN PATENT DOCUMENTS

| | | | |
|---|---|---|---|
| 0252600 | 6/1926 | United Kingdom | 24/90.1 |
| 0698187 | 10/1953 | United Kingdom | 24/90.1 |

*Primary Examiner*—Victor N. Sakran

*Attorney, Agent, or Firm*—Robert M. Downey, P.A.

[57] ABSTRACT

An assembly includes a socket member, a post element, a stud member, and a decorative element. The socket member is secured to a fashion article, such as clothing, accessories (e.g., belts, hats, purse, shoes, etc.) or undergarments using the post element. The decorative element is secured to a front side of the stud member to produce an adornment and may include, but is not limited to, rhinestones, acrylic stones, precious and semi-precious stones, beads, button heads, and crystals. An opposite side of the stud member is structured and configured for releasable, snap fit engagement within the socket member, wherein various individual ones of the assembled adornments may be attached, removed and interchanged on the fashion article in accordance with a desired color scheme, arrangement, and overall appearance.

2 Claims, 3 Drawing Sheets

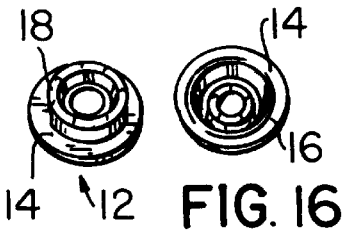
FIG. 16
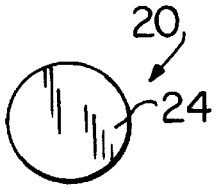
FIG. 17
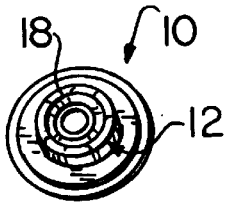
FIG. 18
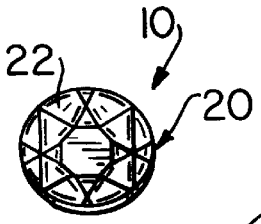
FIG. 19
FIG. 20
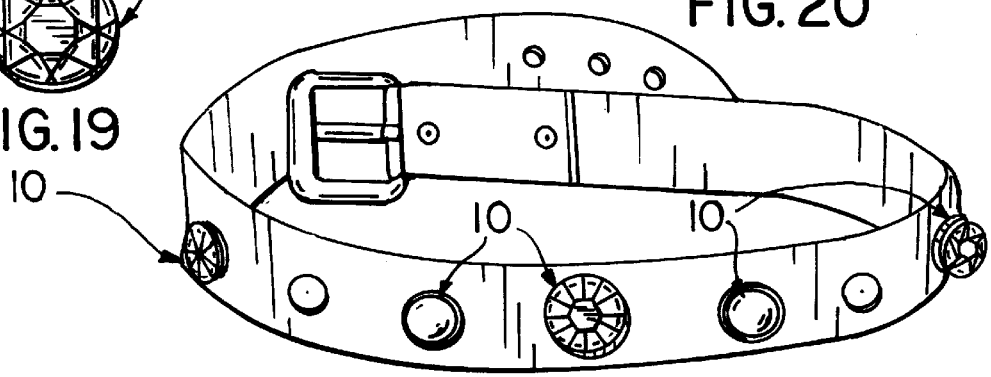

INTERCHANGE SNAP-ON ADORNMENTS FOR FASHION ACCESSORIES

BACKGROUND OF THE INVENTION

1. Field of the Invention

The present invention relates to means for decorating clothing, fashion accessories, undergarments and the like. More specifically, the present invention relates to interchangeable, snap-on adornments for releasable attachment to a socket member fitted to the clothing, fashion accessories, etc.

2. Description of the Related Art

Snap fasteners are well known in the field and comprise a female socket and a male stud, wherein the male stud is specifically structured and configured for releasable, snap fit within the female socket. Snap fasteners are primarily used on garments such as shirts, blouses, jackets, and dresses to hold overlapping edges of the garment together when the garment is worn. Typically, the socket is secured to one edge of the garment using a cap and post fitting. The socket, having a central aperture, receives the post of the cap therethrough so that the garment material is sandwiched between the cap and socket. The post on the cap is then hammered or crimped, in a manner similar to a rivet, to secure the socket on the clothing. The stud is fitted to the opposing edge of the garment using a post. The post is fitted through the stud in much the same manner as described in connection with the cap and socket fixture.

The various snap fastening devices in the related art have all been used for securing members together, such as overlying edges of clothing (e.g., the front panels of a coat). Until now, snap fasteners have not been used for the sole purpose of enhancing the overall appearance of clothing, fashion accessories, and the like. More specifically, snap type fasteners have not been fitted with decorative elements such as rhinestones, acrylic stones, precious and semi-precious stones, beads, crystals, and the like, for releasable, interchangeable attachment on articles of clothing, fashion accessories, undergarments, and other articles for the purpose of providing a more ornamental appearance to the clothing.

Notwithstanding the various and well known snap fastener arrangements known in the art, there still exists a need for a means to enhance the appearance of clothing, belts, pocketbooks, purses, wallets, shoes, watch bands, dog collars, etc. with decorative elements, wherein the conventionally known socket and stud members of a snap fastener are employed for achieving releasable, interchanging of the decorative elements in accordance with a desired appearance.

SUMMARY OF THE INVENTION

The present invention is directed to interchangeable snap-on adornments comprising a socket member, a post fastening element, a stud member, and a decorative element. The socket member is secured to an article of clothing, a fashion accessory such as a belt, hat, purse, shoes, etc. or undergarments using the post fastener. The decorative element may be any item of jewelry including, but not limited to, rhinestones, acrylic stones, precious and semi-precious stones, beads, button heads, and crystals. The decorative element is secured to a flat side of the male stud member using an adhesive substance or an eyelet with prongs. An opposite side of the stud member is structured and configured for releasable, snap fit within the female socket member, wherein various individual ones of the decorative elements may be attached, removed from and interchanged on the clothing article in accordance with a desired color scheme, arrangement, and overall appearance.

BRIEF DESCRIPTION OF THE PHOTOGRAPHIC VIEWS

For a fuller understanding of the nature of the present invention, reference should be made to the following detailed description taken in conjunction with the accompanying photographs in which:

FIGS. 16–19 illustrate a sequence of assembly of the snap-on adornment in accordance with yet another embodiment and method of assembly thereof; and FIG. 20 is a perspective view showing the interchangeable snap-on adornment fitted to an article, such as a belt.

Like reference numerals refer to like parts throughout the several views of the photographs.

DETAILED DESCRIPTION OF THE PREFERRED EMBODIMENTS

Figure 1:
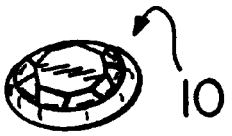
FIG. 1 is a perspective view of the interchangeable snap-on adornment of the present invention, in accordance with one embodiment thereof.
Figure 2:
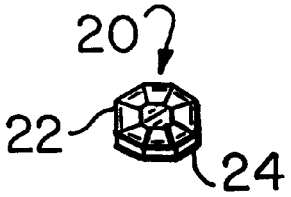
FIG. 2 is a perspective view of a stud member of the invention.
Figure 3:
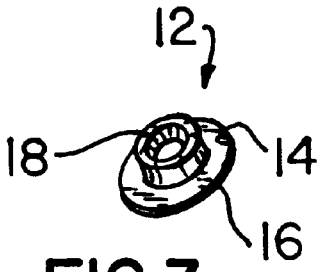
FIG. 3 is a top perspective view of a decorative element of the adornment in accordance with one preferred embodiment thereof.
Figure 4:
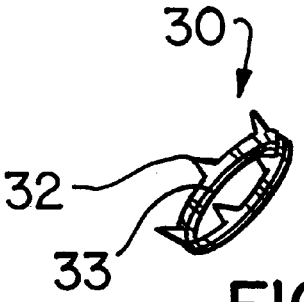
FIG. 4 is a perspective view of a pronged eyelet used on the adornment in one or more embodiments thereof.
Figure 5:
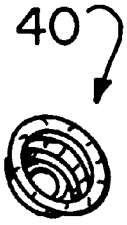
FIG. 5 is a perspective view of a female socket member of the invention.
Figure 6:
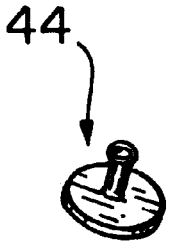
FIG. 6 is a perspective view of a post member for use in securing the socket to an article of clothing, fashion accessory and the like, in accordance with conventionally known techniques.
Figure 7:
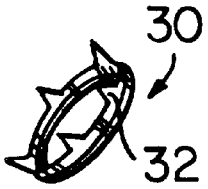
FIGS. 7–10 illustrate a sequence of assembly of the snap-on adornment of the present invention in accordance with one embodiment and method of assembly thereof.
Figure 11:
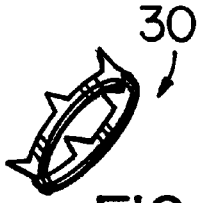
FIGS. 11–15 illustrate a sequence of assembly of the snap-on adornment in accordance with an alternative embodiment and method of assembly thereof.
Figure 8:
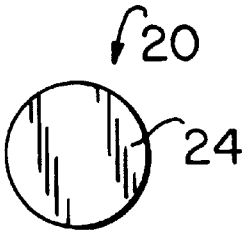
Figure 12:
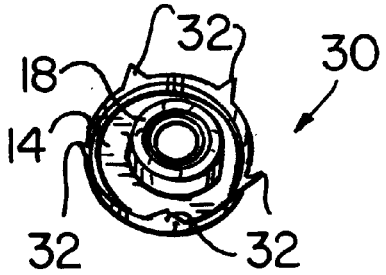
Figure 9:
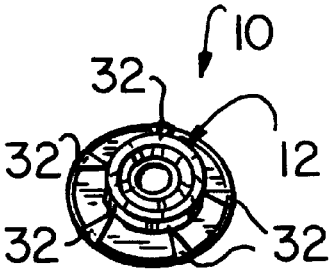
Figure 13:
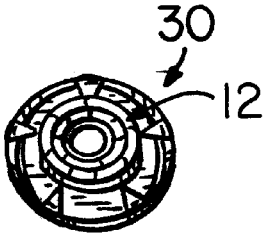
Figure 14:
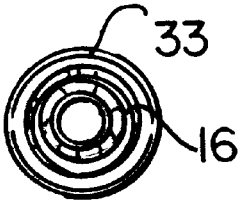
Figure 10:
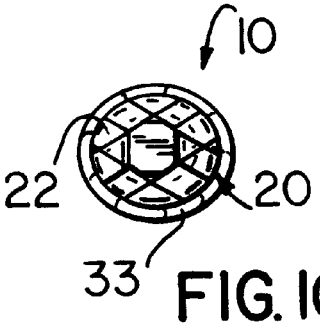

Referring initially to FIGS. 1–6, the primary component elements of the invention are shown. Specifically, the interchangeable snap-on adornment 10 comprises the assembly of a series of components including a stud member 12 having a base 14 with a generally flat, bottom side 16, and a protruding stud element 18 extending from an opposite side. A decorative element 20 includes a top, ornamental side 22 and a generally flat bottom side 24 (see FIG. 17). In some embodiments of the invention, as described more fully hereinafter, a pronged eyelet, such as a five prong eyelet 30, may be used in the assembly of the snap-on adornment 10 to secure the decorative element to the bottom side of the stud member and/or to enhance the overall appearance of the adornment 10 by providing a frame or ornamental rim about the periphery of the decorative element.

To releasably secure the adornment 10 to various articles of clothing, fashion accessories (e.g., belts, hats, purses, wallets, shoes, watch bands, etc.), undergarments and other articles, a conventionally known female socket member 40 of a conventional snap fastener is secured to the article using a post member 44.

Referring to the remaining drawing figures, the method of assembly of the interchangeable, snap-on adornments 10 of the present invention are shown and described in accordance with the following examples:

EXAMPLE 1

Referring to FIGS. 7–10, a method of assembly of the snap-on adornment 10 of the present invention is shown wherein a five prong eyelet 30 is placed on a surface so that the prongs 32 face upwardly.

Next, the decorative element 20 or jewelry piece (e.g., rhinestone, acrylic stone, semi-precious or precious stone, crystal, bead, button head) is placed within the eyelet so that the flat bottom 24 of the decorative element faces upwardly, along with the prongs 32.

Next, the stud member 12 is placed with the flat bottom side 16 of the base 14 against the flat side 24 of the decorative element 20 so that the protruding stud element 18 is exposed on the opposite side of the base. The prongs 32 are then turned downward, by bending, so that they overlie the peripheral flange 15 of the base of the stud member, thereby securing the decorative element and stud member within the eyelet.

Upon turning the snap-on adornment 10 over, the top, ornamental side 22 of the decorative element 20 is visible within the surrounding rim 33 of the five prong eyelet.

In this particular embodiment, the rim of the eyelet is of a diameter slightly less than the outermost diameter of the decorative element, to thereby capture the decorative element between the rim and the base of the stud member.

EXAMPLE 2

Referring to FIGS. 11–15, another embodiment of the snap-on adornment 10 is shown wherein the assembly begins with placing a five prong eyelet on a flat work surface, so that the prongs face upwardly.

Next, the stud member is dropped within the eyelet so that the stud element faces upwardly (the bottom side of the stud member is facing down towards the work surface). The prongs are then turned down, by bending, to secure the stud member within the eyelet.

Next, the combined eyelet and stud member are turned over to expose the rim of the eyelet and the flat, bottom side of the base of the stud member within the rim. The decorative element is then secured to the flat base of the stud member, within the rim of the eyelet, by gluing the flat bottom of the decorative element to the base of the stud member using an industrial strength adhesive material such as an epoxy glue.

Figure 15:
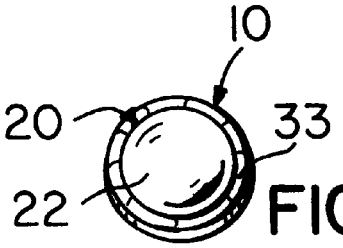

Upon turning the snap-on adornment over, as seen in FIG. 15, the top, ornamental side of the decorative element is visible within the surrounding rim of the eyelet.

EXAMPLE 3

With reference to FIGS. 16–19, the sequence of assembly of yet another embodiment of the snap-on adornment 10 is shown wherein the stud member is inverted so that the flat, bottom side of the base faces upwardly.

Next, the flat bottom side of the decorative element is glued to the flat, bottom side of the base of the stud member using an industrial strength adhesive material.

When the snap-on adornment 10 is turned over, the top ornamental side of the decorative element is visible with the stud element of the snap fastener concealed from view on the underside of the decorative element.

In each of the above examples, the assembled snap-on adornment is adapted for removable, interchangeable attachment with the female socket member of the assembly which has previously been secured to an article of clothing, fashion accessory, undergarment, or like article. Referring to FIG. 20, a plurality of the snap-on adornments 10 are shown attached to the corresponding female socket members on a belt, wherein the adornments may be easily and selectively interchanged to suit the desired appearance of the wearer.

In accordance with the object of the present invention, it is preferable that a plurality of snap-on adornments 10 be fitted to a particular article (clothing, fashion accessory, etc.) wherein a particular design or decorative arrangement is achieved. Further, the snap-on adornments are intended to be individually removed and interchanged with other ones of the decorative adornments 10 in accordance with a desired color scheme, ornamental appearance, and decorative arrangement. For instance, the colors of each of the plurality of snap-on adornments may be chosen to match with other articles of clothing worn by the user. Further, the snap-on adornments 10 may be applied to several articles of clothing and/or fashion accessories (e.g., shoes, belt, blouse and/or hat), wherein the color scheme of the snap-on adornments 10 on each article worn by the user match. It may be further desirable to interchange individual ones of the snap-on adornments 10 in accordance with a desired theme. For example, the decorative elements on each of the adornments 10 may include figurines, various shapes and/or objects, wherein the arrangement of a plurality of the snap-on adornments 10 completes a desired theme and/or appearance.

While the instant invention has been shown and described in connection with preferred and practical embodiments thereof, it is recognized that departures may be made from the instant disclosure which, therefore, should not be limited except as defined in the following claims as interpreted under the doctrine of equivalents.

Now that the invention has been described,

What is claimed is:

1. An assembly for decorating clothing articles and accessories for clothing, said assembly comprising:

an adornment comprising:

a stud member having a base with a generally flat, bottom side, and a protruding stud element extending from an opposite side of said base;

a decorative element including a top, ornamental side and an opposite flat, bottom side;

means for attaching said decorative element to said stud member so that said flat bottom side of said decorative element is disposed in mating engagement with said flat, bottom side of said base; and said means for attaching said decorative element to said stud member including an eyelet having an annular rim and a plurality of prongs extending from said annular rim, said annular rim being structured and disposed to engage an outer peripheral edge of said decorative element to thereby hold said decorative element against said stud member, and said plurality of prongs being structured and disposed to bend and engage said base of said stud member to thereby secure said eyelet to said stud member;

means for releasably fastening said adornment to the clothing articles and accessories and including:

a female socket member structured and disposed for snap fit, releasable engagement with said stud element of said stud member; and a fastening element for attaching said female socket member to the clothing articles and accessories, said fastening element including a flat base portion and a post extending from said flat base portion, said post being structured and disposed to extend through the clothing articles and accessories and into fixed, attached engagement with said female socket member.

2. A method for decorating clothing articles and accessories for clothing, said method comprising the steps of:

providing a plurality of stud members having a base with a generally flat, bottom side, and a protruding stud element extending from an opposite side of said base;

providing a plurality of decorative elements including a top, ornamental side and an opposite flat, bottom side;

providing a plurality of eyelets, each of said eyelets including an annular rim and a plurality of prongs extending from said rim;

providing a plurality of socket members structured and disposed for snap fit, releasable engagement with said stud element of said stud member;

providing a plurality of fastening elements for attaching said female socket member to the clothing articles and accessories, each of said fastening elements including a post extending from a flat base portion, said post being structured and disposed to extend through the clothing articles and accessories and into fixed, attached engagement with said socket member;

selectively positioning said plurality of fastening elements on the clothing articles and accessories and attaching said socket members to said posts of said respective fastening elements;

placing said decorative element within said annular rim of said eyelet so that said flat bottom of said decorative element and said prongs of said eyelet face upwardly;

placing said flat, bottom side of one of said stud members against said flat side of said decorative element so that said protruding stud element is exposed opposite of said top, ornamental side of said decorative element;

bending said prongs downwardly and inwardly relative to said flat bottom of said decorative element and said annular rim, so that said prongs engage said flat bottom of said decorative element, holding said decorative element between said annular rim and said plurality of prongs to produce an adornment; and selectively positioning and interchanging a plurality of said produced adornments on said clothing articles and accessories by releasably attaching said stud elements of said produced adornments in snap fit engagement with corresponding ones of said socket members.

* * * * *